2/11/86 4,569,731

United States Patent [19]

Matsuda et al.

[11] Patent Number: 4,569,731

[45] Date of Patent: Feb. 11, 1986

[54] PRODUCTION OF ZN-NI ALLOY PLATED STEEL STRIPS

[75] Inventors: Akira Matsuda; Akira Komoda; Takahisa Yoshihara; Kazuaki Miyachi, all of Chiba, Japan

[73] Assignee: Kawasaki Steel Corporation, Hyogo, Japan

[21] Appl. No.: 726,290

[22] Filed: Apr. 23, 1985

[30] Foreign Application Priority Data

Apr. 25, 1984 [JP] Japan ..... 59-83412

[51] Int. Cl.[4] ..... C25D 3/56; C25D 7/06

[52] U.S. Cl. ..... 204/28; 204/44.2

[58] Field of Search ..... 204/28, 44.2

[56] References Cited

U.S. PATENT DOCUMENTS

| | | | |
|---|---|---|---|
| 2,679,475 | 5/1954 | Singler | 204/44.5 |
| 2,844,530 | 7/1958 | Wesley et al. | 204/44.5 |
| 3,420,754 | 1/1969 | Roehl | 204/28 |
| 4,249,999 | 2/1981 | Tsuda | 204/28 |
| 4,282,073 | 8/1981 | Hirt | 204/28 |
| 4,285,802 | 8/1981 | Rynne | 204/44.2 |
| 4,313,802 | 2/1982 | Shibuya | 204/28 |
| 4,388,160 | 6/1983 | Rynne | 204/44.2 |
| 4,416,737 | 11/1983 | Austin | 204/28 |

FOREIGN PATENT DOCUMENTS

| | | | |
|---|---|---|---|
| 70462 | 12/1969 | German Democratic Rep. | 204/44.2 |
| 58-55585 | 4/1983 | Japan | 204/44.2 |
| 58-110688 | 7/1983 | Japan | 204/44.2 |
| 2104920 | 3/1983 | United Kingdom | 204/44.2 |
| 827608 | 8/1981 | U.S.S.R. | 204/44.2 |

*Primary Examiner*—T. M. Tufariello

*Attorney, Agent, or Firm*—Young & Thompson

[57] ABSTRACT

Steel strips are electrogalvanized with a Zn-Ni alloy deposit having the desired nickel content in a consistent manner for a long time by placing separate Zn and Ni soluble anodes in a chloride plating bath comprising major proportions of $ZnCl_2$ and $NiCl_2$ in an Ni/(Zn+Ni) ratio between 0.08 and 0.20 and a total molar amount of Zn+Ni of from 1 to 4 moles per liter, and b mole per liter of KCl and a mole per liter of $NH_4Cl$ as shown in FIG. 8; passing a steel strip through the bath; and introducing currents to the soluble Zn and Ni anodes in a specific ratio given by equation (2).

3 Claims, 10 Drawing Figures

PRODUCTION OF ZN-NI ALLOY PLATED STEEL STRIPS

BACKGROUND OF THE INVENTION

This invention relates to a process for producing Zn-Ni alloy plated steel strips.

Zn-Ni alloy plated steel strips are favorably evaluated as one of well-balanced automotive stocks because they are not only corrosion resistant, but also exhibit excellent properties required for automotive stocks including paintability, weldability, and workability.

Electro-galvanizing processes are most commonly used to deposit a Zn-Ni alloy layer on steel. Traditionally, the plating bath is a sulfate bath containing major proportions of zinc sulfate and nickel sulfate. Since the Ni anode is passivated and becomes insoluble in the sulfate bath, an insoluble Ni anode are used. Zn and Ni ions are replenished by individually dissolving Zn and Ni metals in water with the aid of suitable chemical agents to form make-up solutions outside the bath and adding the make-up solutions to the bath. This prior art process suffers from several problems.

(1) The mechanism of deposition of an alloy plating in the sulfate bath is abnormal codeposition in which Zn is preferentially deposited. In order to obtain a single $\gamma$ phase layer (nickel content 10–20%) having the best quality, the nickel molar ratio Ni/(Zn+Ni) in the bath should be increased up to as high as 0.60 to 0.70. The high concentration of expensive nickel increases the cost of bath formulation and the cost of make-up for a drag-out loss. (2) The concentration of Zn and Ni in the plating bath is gradually reduced as they are deposited onto the steel strip and lost by dragging out. To accommodate such concentration reduction, the bath must be frequently analyzed by means of a suitable analyzer capable of high precision analysis on line, for example, fluorescent X-ray analyzer for the purpose of making up chemicals or metals from outside the plating system. Bath maintenance is thus complicated and difficult.

(3) The insoluble anodes used are Pb alloys and Ti-Pt alloys which tend to deteriorate upon aging. Repair of such deteriorated anodes is expensive. In addition, dissolved-out anode materials contaminate the bath, and among others, lead is known to adversely affect the plating process. Lead in the bath may be filtered off by co-precipitating it with strontium carbonate although this process requires a large filter system and adds to a burden of associated operations like filter cleaning.

(4) The nickel content in a deposit should be consistent within a coil into which the plated strip is wound and between coils. Since the nickel content, however, tends to be affected by current density, line speed, and plating solution flow velocity, these operating parameters should be kept constant in every plating section in the electrogalvanizing line. The current density and line speed are difficult to keep them constant because they vary with strip width and deposit weight.

Since the alloy plating in sulfate bath has several problems as mentioned above, the inventors paid attention to the chloride bath which despite of poor deposit appearance, has only problems (1) and (3) among the above-mentioned problems (1) to (4) and presents the advantage of low electric power consumption due to increased conductivity. The result of this research is disclosed in U.S. patent application Ser. No. 568,189 filed on Dec. 30, 1983, which has solved the problems by using a plating solution having a composition as defined by the shaded region in FIG. 9. That is, a Zn-Ni alloy deposit of single $\gamma$-phase (Ni 10 to 20%) having the best surface properties among Zn-Ni alloy deposits is obtained by preparing a plating solution having a composition within the region shown in FIG. 9.

The inventors encountered a problem in the use of the thus formulated plating solution. The anodes used in this chloride bath are soluble Zn and Ni anodes. The efficiencies of these anodes widely vary or are inconsistent. It is thus very difficult to set the currents introduced into the Zn and Ni anodes to optimum values and the current values are, in practice, adjusted through a trial-and-error or empirical procedure. During long term operation, the Ni and Zn concentrations of the bath deviate from the initial well-balanced relation. The resulting Zn-Ni alloy deposit become inconsistent in nickel content with the progress of plating, failing to always ensure the quality the users require.

SUMMARY OF THE INVENTION

It is, therefore, an object of the present invention to provide a new and improved process for electrodepositing a Zn-Ni alloy plating having a consistent nickel content on a steel strip at low cost while minimizing the operational burden of plating bath maintenance.

According to the present invention, there is provided a process for producing a Zn-Ni alloy plated steel strip comprising placing soluble Zn and Ni anodes in a chloride plating bath comprising major proportions of $ZnCl_2$ and $NiCl_2$ in an Ni/(Zn+Ni) ratio between 0.08 and 0.20 and a total molar amount of Zn+Ni of from 1 to 4 moles per liter, and b mole per liter of KCl and a mole per liter of $NH_4Cl$, with the proviso that $-(4.0/4.7)a+4.0 \leqq b \leqq -(5.4/7.1)a+5.4$ $a \geqq 0$, and $b \geqq 0$, passing a steel strip through the bath, and introducing currents to the soluble Zn and Ni anodes to thereby deposit a Zn-Ni alloy plating on the steel strip, wherein the currents to the respective anodes are controlled to meet the following equation:

$$I_{Zn}:I_{Ni} = \frac{100-x}{100} \times \frac{C_{Zn}}{\eta_{Zn}} : \frac{x}{100} \times \frac{C_{Ni}}{\eta_{Ni}}$$

wherein $I_{Zn}$ is a current introduced into the Zn anode as expressed in ampere, $I_{Ni}$ is a current introduced into the Ni anode as expressed in ampere, x is the content of Ni in the plating as expressed in percentage, $C_{Zn}$ is the electrochemical equivalent of Zn equal to 0.34 mg/coulomb, $C_{Ni}$ is the electrochemical equivalent of Ni equal to 0.30 mg/coulomb, $\eta_{Zn}$ is an anodic efficiency of the Zn anode as expressed in percentage, and $\eta_{Ni}$ is an anodic efficiency of the Ni anode as expressed in percentage.

The anodic efficiencies are in the following ranges:

$95\% \leqq \eta_{Zn} \leqq 110\%$ and $90\% \leqq \eta_{Ni} \leqq 100\%$.

BRIEF DESCRIPTION OF THE DRAWINGS

The above and other objects, features, and advantages of the present invention will be better understood by reading the following description when taken in conjunction with the accompanying drawings, in which.

DETAILED DESCRIPTION OF THE INVENTION

Through extensive investigations, the inventors have found that the following process is effective in solving the above-mentioned problems.

The plating bath should contain (i) major proportions of $ZnCl_2$ and $NiCl_2$ in an Ni/(Zn+Ni) ratio between 0.08 and 0.20 (also referred to as the nickel molar percent range between 8% and 20%) and a total molar amount of Zn+Ni of from 1 to 4 moles per liter and (ii) b mole per liter of KCl and a mole per liter of $NH_4Cl$ as conductive aids, with the proviso that $$-(4.0/4.7)a+4.0 \leqq b \leqq -(5.4/7.1)a+5.4$$

$$a \geqq 0, \text{ and}$$

$$b \geqq 0.$$

The choice of such a specific chloride bath will be discussed in comparison with conventional sulfate and chloride baths to clarify the reason of choice.

(1) Soluble Zn and Ni anodes are preferably used in order to provide the ease of bath maintenance. The conventional sulfate bath has the problem that nickel is difficultly soluble therein and the conventional chloride bath has the problem that anode efficiency varies over a wide range. On the contrary, the chloride bath used in the practice of the present invention advantageously offers an anodic efficiency of substantially 100% for both the Zn and Ni anodes.

Figure 6A:
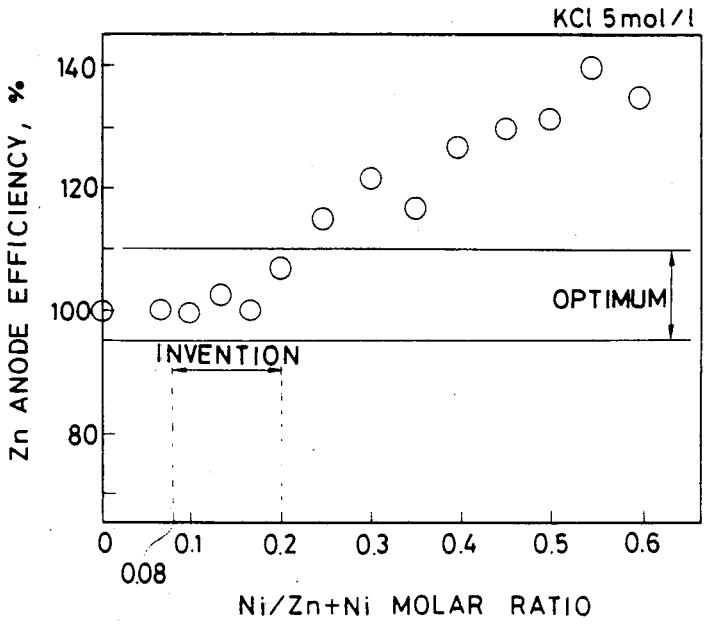
FIGS. 6A and 6B are diagrams showing Zn and Ni anode efficiencies in relation to bath composition, respectively.
Figure 6B:
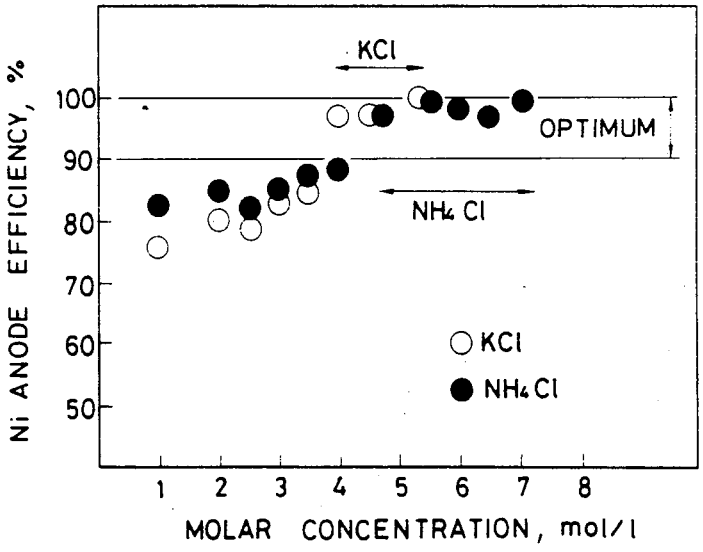

FIGS. 6A and 6B are diagrams in which anodic efficiency is plotted in relation to plating bath composition. The Zn anode efficiency is plotted in relation to the Ni/(Zn+Ni) molar ratio in FIG. 6A, and the Ni anode efficiency is plotted in relation to the molar concentrations (mol/l) of KCl and $NH_4Cl$ in FIG. 6B. As evident from these diagrams, the Zn anode efficiency widely varies beyond 110% and the Ni anode efficiency widely varies below 90% in conventional chloride baths. The Zn anode efficiency remains stable in the optimum range between 95% and 110% when the nickel molar ratio is between 0.08 and 0.2 and the Ni anode efficiency remains stable in the optimum range between 90% and 100% when the concentrations of KCl and $NH_4Cl$ are in the ranges according to the present invention, that is, in the plating baths according to the present invention. This has been discovered by the inventors. Although the present invention is not limited to a particular theory, the reason for consistent anodic efficiency is speculated as follows.

It is believed for the Zn anode efficiency that at higher nickel molar ratios (more than 0.2) in plating solution, the substituting deposition of Ni occurs on the Zn anode to chemically dissolve out zinc, causing the Zn anode efficiency to extremely increase beyond 110%. In general, the Ni anode efficiency is low because the Ni anode has an oxide film formed on its surface and is thus passivated. Increased chloride concentrations act to break the passive film and allows the nickel to be smoothly dissolved, leading to increased efficiencies as high as 90% or higher.

(2) Chloride baths have an electric conductivity of 400 to 500 ms/cm which is higher by a factor of 4 or 5 than sulfate baths, and thus require less power consumption.

(3) KCl and $NH_4Cl$ are chosen as conductive aids because they are highly conductive, highly soluble, and less costly, and do not cause cations to codeposit in the plating.

Figure 8:
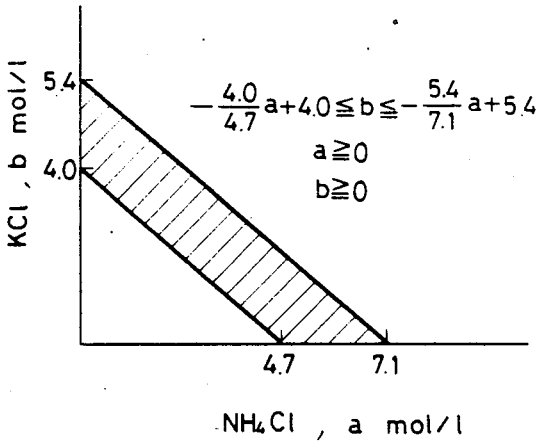
FIG. 8 is a diagram showing the region of the amounts of KCl and $NH_4Cl$.

(4) The concentrations of KCl and $NH_4Cl$ are limited to the region illustrated as a shaded region in FIG. 8. It is necessary that a mole per liter of $NH_4Cl$ and b mole per liter of KCl satisfy the equations:

$$-(4.0/4.7)a+4.0 \leqq b \leqq -(5.4/7.1)a+5.4$$

$$a \geqq 0, \text{ and}$$

$$b \geqq 0,$$

When KCl and $NH_4Cl$ are individually used, their amounts should fall in the ranges between 4.0 and 5.4 mol/l and 4.7 and 7.1 mol/l, respectively. The reason is similar to (1). Within this region, normal codeposition occurs in which the nickel molar percentage in the plating bath is substantially equal to the nickel content in deposits. Less abnormal codeposition occurs in conventional chloride baths than in sulfate baths and such abnormal codeposition is further mitigated or avoided in the chloride baths according to the present invention.

Figure 7:
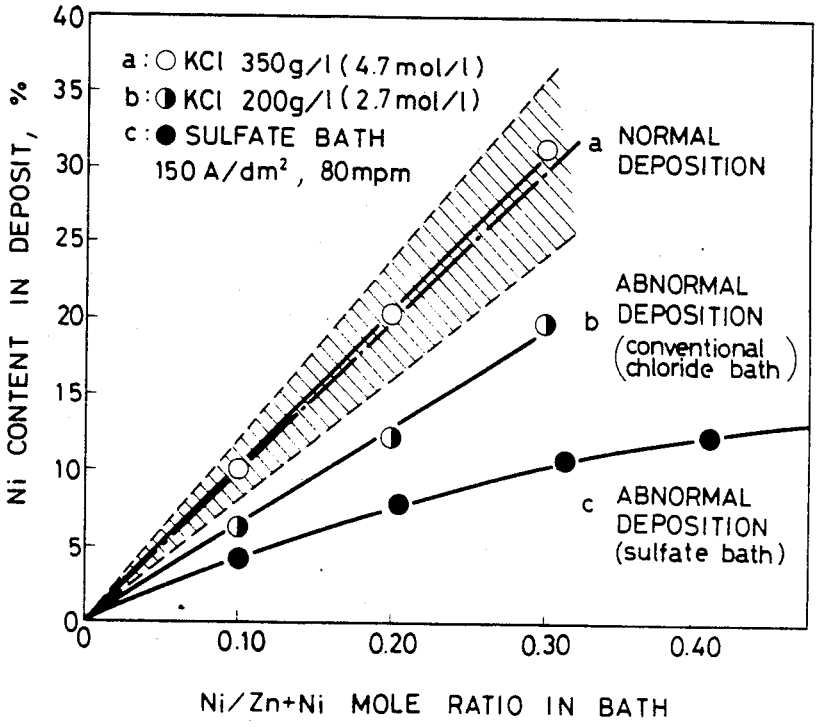
FIG. 7 is a diagram in which the nickel content in deposit is plotted in relation to the nickel molar ratio in bath.
Figure 9:
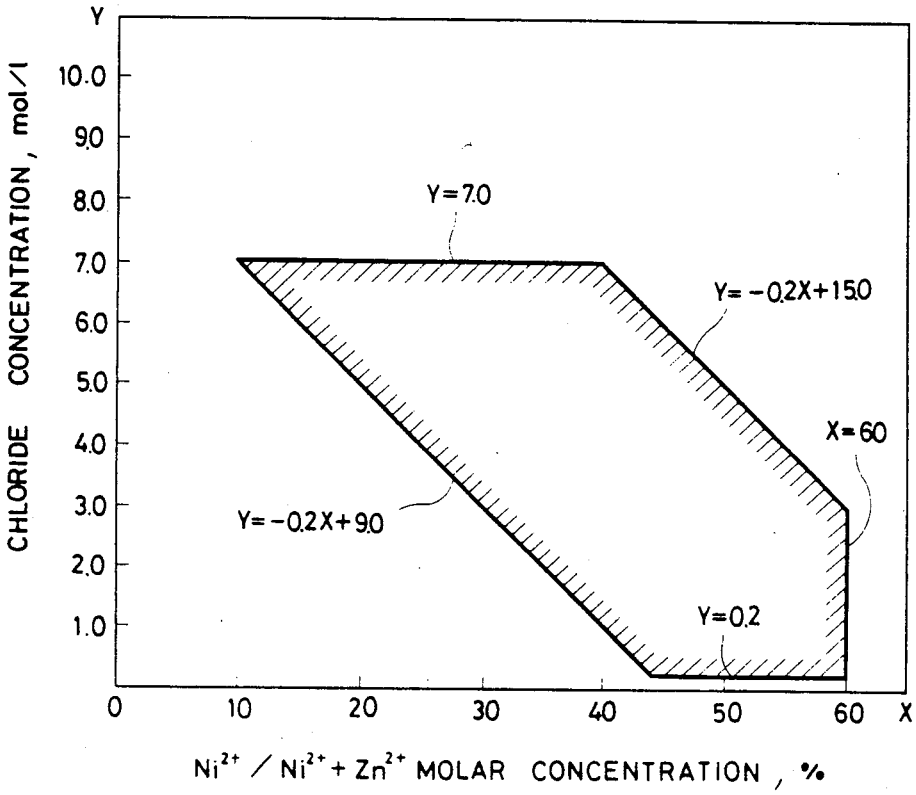
FIG. 9 Prior art
FIG. 9 is a diagram showing the composition of a chloride bath according to the preceding application.

The relationship of the nickel molar percentage in plating bath to the nickel content in deposit is illustrated in FIG. 7. Zn-Ni alloy plating is known to show abnormal deposition behavior so that the nickel content (%) in the deposited film is markedly lower than that in the plating bath as seen from curve b corresponding to conventional chloride baths and curve c corresponding to sulfate baths. On the contrary, the nickel content (%) in the deposited film is substantially equal to that in the plating bath as seen from curve a according to the present invention. By the term "normal deposition" used in the present specification is meant that x and y meet the following equation:

$$y=kx \tag{1}$$

wherein x is the nickel molar ratio in plating bath, y is the percent nickel content in deposited film, and k is a constant equal to 100±20.

The region covered by equation (1) is shown in FIG. 7 as a shaded region.

The use of the above-specified chloride bath results in the advantages that the nickel content in platings or deposits becomes stable and consistent independent of current density, line speed, and solution flow velocity, and that the concentration of expensive nickel in the plating bath can be reduced.

Based on the discovery of equation (1) as defined above, the inventors have found that currents to be separately introduced into soluble Zn and Ni anodes should be controlled in accordance with the nickel content in the deposit. That is, the currents to Zn and Ni anodes should be controlled so as to meet the following equation:

$$I_{Zn}:I_{Ni} = \frac{100-x}{100} \times \frac{C_{Zn}}{\eta_{Zn}} : \frac{x}{100} \times \frac{C_{Ni}}{\eta_{Ni}} \quad (2)$$

wherein $I_{Zn}$ is a current introduced into the Zn anode as expressed in ampere, $I_{Ni}$ is a current introduced into the Ni anode as expressed in ampere, x is the content of Ni in the plating as expressed in percentage, $C_{Zn}$ is the electrochemical equivalent of Zn equal to 0.34 mg/C, $C_{Ni}$ is the electrochemical equivalent of Ni equal to 0.30 mg/C, $\eta_{Zn}$ is an anodic efficiency of the Zn anode as expressed in percentage, and $\eta_{Ni}$ is an anodic efficiency of the Ni anode as expressed in percentage.

As described above, the anodic efficiencies fall in the following ranges:

$95\% \leqq \eta_{Zn} \leqq 110\%$ and $90\% \leqq \eta_{Ni} \leqq 100\%$. Although the anodic efficiencies vary with bath composition, bath temperature, current density and other parameters, the anodic efficiencies can be regarded to be constants determined by plating conditions like bath composition and temperature because the influence of current density is negligible in actual applications.

By controlling the introducing currents, Zn and Ni are replenished from the soluble anodes as they are consumed, that is, in proportion to the quantities of Zn and Ni deposited on a steel strip so that the plating bath concentration is kept optimum without any particular measure. The amount of chemical agents to be replenished is only the difference between the cathodic efficiency and the drag-out and thus very small, also providing ease of bath maintenance.

The soluble anodes used in the practice of the present invention may take the form of ingots, plates, bars or the like as well as baskets filled with Zn and Ni pellets which are advantageous in cost and replacement. The soluble anodes are also convenient in that they are free of contaminants such as lead.

The ratio in surface area of Ni anode to Zn anode is preferably in conformity to the desired nickel content in deposit although they need not be in strict conformity. Nickel contents in the range of 10 to 15% may be conveniently obtained by using one Ni anode and seven Zn anodes provided that all the anodes have an equal surface area.

The Zn-Ni alloy platings or deposits exhibit improved corrosion resistance when the nickel content ranges from 10% to 20% by weight. The conditions under which such corrosion resistant deposits are obtained are described below.

(i) The nickel molar ratio in plating bath is set in correspondence with the desired nickel content in deposit according to equation (1). The addition of 4.0 to 5.4 mol/l of KCl or 4.7 to 7.1 mol/l of $NH_4Cl$ enables this setting. There results the advantage that the nickel molar ratio in plating bath remain unchanged despite a concentration reduction due to drag-out. The amounts of KCl and $NH_4Cl$ are limited to the upper limits of 5.4 mol/l and 7.1 mol/l, respectively, where their effects are saturated. When KCl and $NH_4Cl$ are used in combination, the molar amount b (mol/liter) of KCl and the molar amount a (mol/liter) of $NH_4Cl$ must meet the following conditions:

$-(4.0/4.7)a+4.0 \leqq b \leqq -(5.4/7.1)a+5.4$ $a \geqq 0$, and $b \geqq 0$.

The region given by these equations is depicted in FIG. 8.

(ii) The plating bath is preferably adjusted to pH 3 to 5. The amount of iron (Fe) dissolved from steel strip is increased at a pH value of less than 3 whereas deposits give poor appearance at a pH value of more than 5.

(iii) The bath temperature is preferably adjusted to 40° C. to 65° C. Burnt or dendrite deposits tend to form at temperatures of lower than 40° C. High temperatures in excess of 65° C. are inconvenient because plating equipment are liable to attack by chemicals.

(iv) The total concentration of zinc and nickel should range from 1 to 4 mol/liter. Burnt deposits tend to form at lower concentrations whereas higher concentrations are costly.

(v) The current density is not particularly limited in the practice of the present invention although it generally ranges from 20 to 200 A/dm$^2$ (ampere/square decimeter).

In abnormal deposition type platings, the Ni to Zn ratio in the plating solution is different from that in the resultant deposit, which means that rate of consumption differs between Ni and Zn. In order to continuously produce a deposit having the desired Ni to Zn ratio in a consistent manner, the Ni to Zn ratio in the bath should be always maintained at the optimum value.

On the contrary, the normal deposition type plating is characterized in that nickel and zinc are consumed at rates substantially conforming to the Ni to Zn ratio in the bath. The only requirement is the provision of means for dissolving nickel and zinc into the bath at the predetermined rates, that is, means for individually introducing currents to the nickel and zinc anodes in the ratio given by equation (2).

Examples of the present invention are given below by way of illustration and not by way of limitation.

EXAMPLE 1

A Zn-Ni alloy deposit was applied to one surface of a length of steel strip which was passed through four radial cells filled with a chloride plating solution havin the following composition. The line speed was varied from 40 to 120 m/min. and the current density was varied from 50 to 200 A/dm$^2$. The resulting deposit was analyzed for nickel content by X-ray fluorometry.

| Plating solution | |
|---|---|
| $ZnCl_2$ | 1.76 mol/l |
| $NiCl_2 .6H_2O$ | 0.24 mol/l |

-continued

| | |
|---|---|
| $NH_4Cl$ | 5.6 mol/l |
| Ni molar ratio | 0.12 |
| pH | 4 |
| Temperature | 60° C. |
| Anode | |
| Soluble Zn anode | 7 units |
| Soluble Ni anode | 1 units |
| Current ratio | $I_{Zn} : I_{Ni} = 6.6:1$ |

Figure 1:
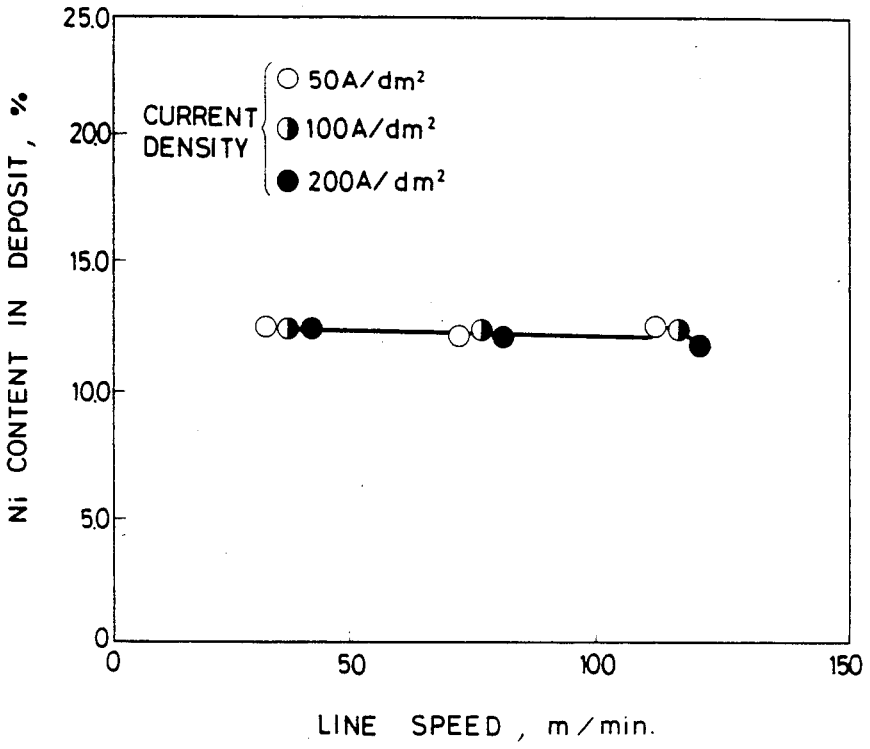
FIG. 1 is a diagram in which the nickel content in deposit is plotted in relation to line speed and current density in Example 1.

The nickel content measurements are plotted in relation to the line speed and current density in FIG. 1. It is evident that the nickel content of 12wt% is consistently achieved in every deposit independent of the line speed and current density according to the present invention.

EXAMPLE 2

Figure 2:
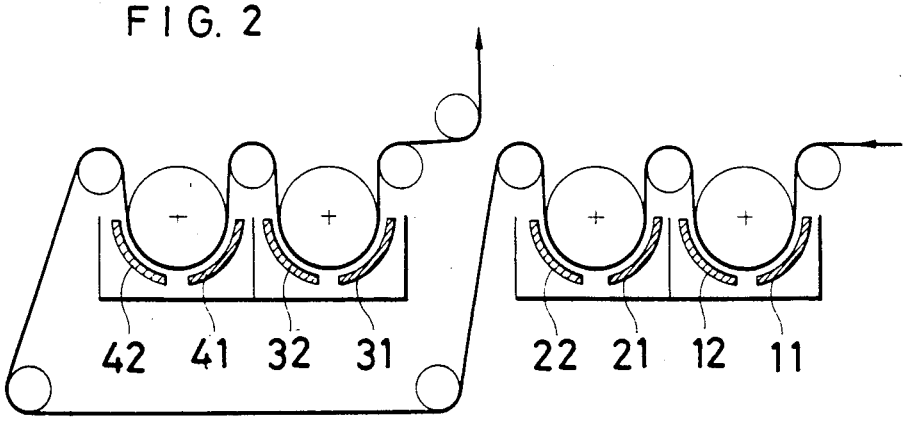
FIG. 2 schematically illustrates an electrogalvanizing line used in Example 2.

An electrogalvanizing line (E.G.L.) as shown in FIG. 2 was prepared including four radical cells equipped with Zn anodes 11, 12, 21, 22, 31, 32, and 41 and an Ni anode 42. A Zn-Ni alloy deposit was continuously applied for 24 hours to either surface of a length of steel strip which was passed through the cells. The composition of the chloride plating solution wich which the cells were filled and the electrolytic conditions are given below.

| | |
|---|---|
| Platino solution | |
| $ZnCl_2$ | 2.2 mol/l |
| $NiCl_2.6H_2O$ | 0.3 mol/l |
| KCl | 4.5 mol/l |
| Ni molar ratio | 0.12 |
| pH | 4.5 |
| Temperature | 55° C. |
| Anode | |
| Soluble Zn anode | 7 units (11, 12, 21, 22, 31, 32, 41 in FIG. 2) |
| Zn anode current | 23,400 amperes per anode total 163,800 amperes |
| Soluble Ni anode | 1 units (42 in FIG. 2) |
| Ni anode current | 24,800 amperes |
| Current ratio | $I_{Zn}:I_{Ni} = 1:6.6$ |
| Strip | 1,000 mm wide |
| Line speed | 80 m/min. |
| Current density | 142 A/dm$^2$ for Zn anode 150 A/dm$^2$ for Ni anode |
| Deposit weight | 20/20 g/m$^2$ |

Figure 3:
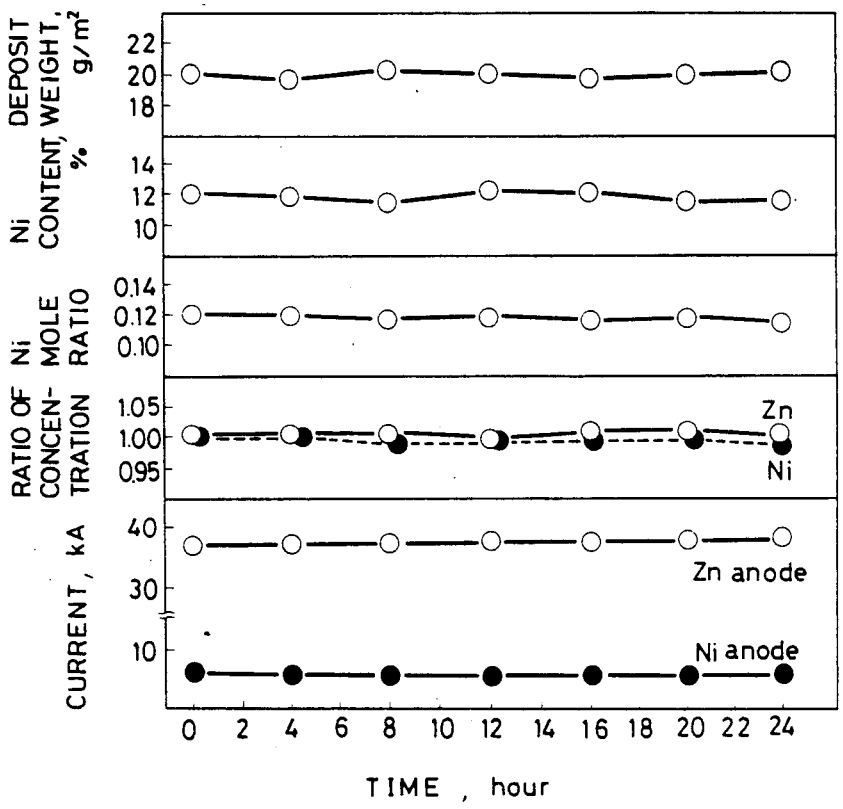
FIG. 3 is a diagram showing the variation of bath concentration, deposit weight, and deposit nickel content with time during continuous plating operation in Example 2.

FIG. 3 shows how the bath concentration and the weight and nickel content of deposits varied during the 24-hour continuous plating operation. Despite of no replenishment of chemical agents, the bath concentration was constant as well as the weight and nickel content of deposits.

Figure 4:
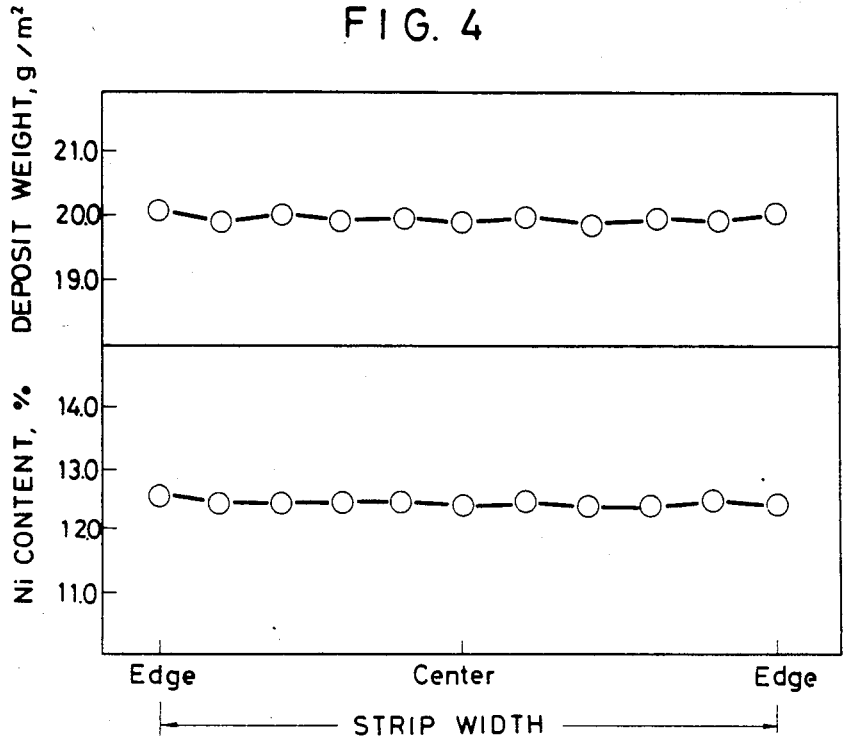
FIGS. 4 and 5 are diagrams of the analytic profiles of a deposit formed on a steel strip in Example 2 in the width and depth directions, respectively.
Figure 5:
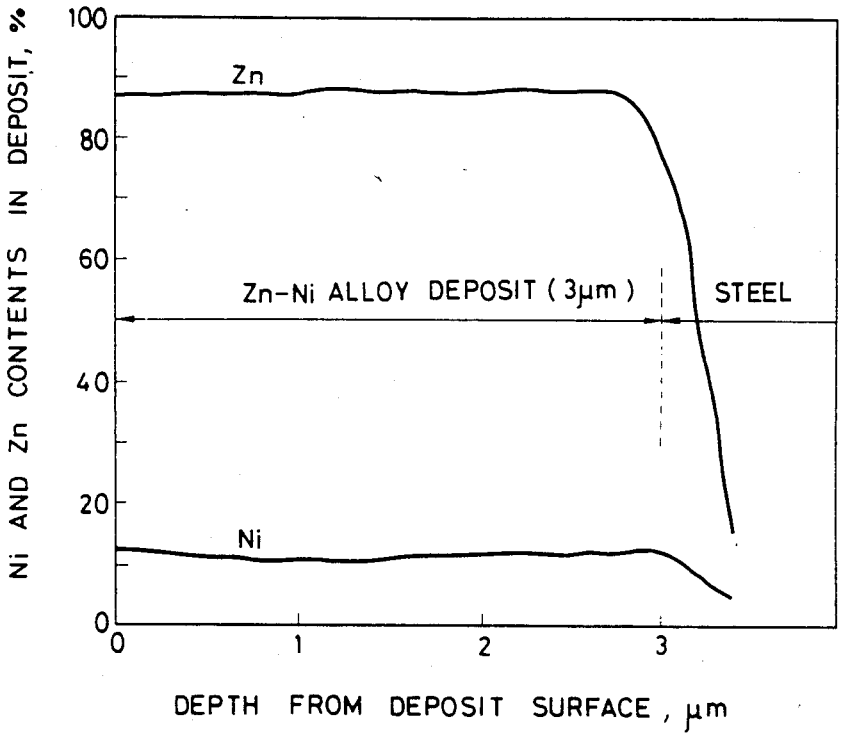

A sample was taken from the final coil in the 24 hour operation and analyzed in width and depth directions. The width direction profile was measured by X-ray fluorometry and the depth direction profile was measured by means of an ion mass microanalyzer (IMMA). The width direction profile is shown in FIG. 4 and the depth direction profile was shown in FIG. 5. It is evident that both the profiles are uniform.

These results prove that the present invention is successful in producing improved plated steel strips having a consistent Zn-Ni alloy layer deposited over long term operation. The maintenance of plating bath concentration is very easy as well as the operation of the electrogalvanizing line.

EXAMPLE 3

Test runs were conducted under the same conditions as in Example 2 except that the Ni molar ratio and KCl concentration in plating bath were changed.

The results are shown in Table 1.

The nickel content in deposits is evaluated uniform as long as its variation in the strip width and depth directions is within 1%. Uniform nickel contents are marked "O" and somewhat non-uniform nickel contents are marked "X" in Table 1.

The bath concentration after the 24-hour continuous operation was marked "O" when unchanged and "X" when changed.

It is evident that good results are obtained when all the parameters are within the scope of the present invention.

| Run No. | Ni mol ratio in bath | Chloride concentration (mol/l) | Ni content in deposit (%) | Uniformity of Ni content in deposit | Variation of bath concentration with time |
|---|---|---|---|---|---|
| 1 | 0.08 | KCl 5.0 | 11 | O | O |
| 2 | 0.08 | $NH_4Cl$ 7.1 | 11 | O | O |
| 3 | 0.13 | KCl 2.0 + $NH_4Cl$ 2.5 | 12 | O | O |
| 4* | 0.13 | KCl 1.0 | 5 | X | X |
| 5* | 0.13 | KCl 3.0 | 10 | X | X |
| 6 | 0.13 | KCl 4.0 | 12 | O | O |
| 7 | 0.13 | KCl 5.0 | 14 | O | O |
| 8* | 0.20 | KCl 3.0 | 13 | X | X |
| 9* | 0.13 | $NH_4Cl$ 2.0 | 7 | X | X |
| 10* | 0.13 | $NH_4Cl$ 4.0 | 11 | X | X |
| 11 | 0.13 | $NH_4Cl$ 5.0 | 12 | O | O |
| 12 | 0.13 | $NH_4Cl$ 7.0 | 14 | O | O |
| 13* | 0.20 | $NH_4Cl$ 3.5 | 13 | X | X |

*outside the scope of the invention

I claim:

1. A process for producing a Zn-Ni alloy plated steel strip comprising placing soluble Zn and Ni anodes in a chloride plating bath comprising major proportions of $ZnCl_2$ and $NiCl_2$ in an Ni/(Zn+Ni) ratio between 0.08 and 0.20 and a total molar amount of Zn+Ni of from 1 to 4 moles per liter, and b mole per liter of KCl and a mole per liter of $NH_4Cl$, with the proviso that $-(4.0/4.7)a+4.0 \leqq b \leqq -(5.4/7.1)a+5.4$ $a \geqq 0$, and $b \geqq 0$, passing a steel strip through the bath, and introducing currents to the soluble Zn and Ni anodes to thereby deposit a Zn-Ni alloy plating on the steel strip, wherein the currents to the respective anodes are controlled to meet the following equation:

$$I_{Zn}:I_{Ni} = \frac{100 - x}{100} \times \frac{C_{Zn}}{\eta_{Zn}} : \frac{x}{100} \times \frac{C_{Ni}}{\eta_{Ni}}$$

wherein $I_{Zn}$ is a current introduced into the Zn anode as expressed in ampere, $I_{Ni}$ is a current introduced into the Ni anode as expressed in ampere, x is the content of Ni in the plating as expressed in percentage, $C_{Zn}$ is the electrochemical equivalent of Zn equal to 0.34 mg/C, $C_{Ni}$ is the electrochemical equivalent of Ni equal to 0.30 mg/C, $\eta_{Zn}$ is an anodic efficiency of the Zn anode as expressed in percentage, and $\eta_{Ni}$ is an anodic efficiency of the Ni anode as expressed in percentage, the anodic efficiencies being in the following ranges:

$95\% \leqq \eta_{Zn} \leqq 110\%$ and $90\% \leqq \eta_{Ni} \leqq 100\%$.

2. A process according to claim 1 wherein the bath is adjusted to pH 3 to 5.

3. A process according to claim 1 wherein the bath is kept at a temperature of about 40° to 65° C.

* * * * *

UNITED STATES PATENT AND TRADEMARK OFFICE

CERTIFICATE OF CORRECTION

PATENT NO. : 4,569,731

DATED : Feb. 11, 1986

INVENTOR(S) : Akira Matsuda, et al.

It is certified that error appears in the above-identified patent and that said Letters Patent is hereby corrected as shown below:

Column 9, Claim 1, lines 6-10, change:

$$"I_{Zn} : I_{Ni} = \frac{100 - x}{100} \times \frac{C_{Zn}}{\eta_{Zn}} : \frac{x}{100} \times \frac{C_{Ni}}{\eta_{Ni}}" \text{ to}$$

$$--I_{Zn} : I_{Ni} = \frac{100 - x}{100} \times \frac{1}{C_{Zn} \times \eta_{Ni}} : \frac{x}{100} \times \frac{1}{C_{Ni} \times \eta_{Ni}}--$$

Signed and Sealed this

Nineteenth Day of September, 198

*Attest:*

*Attesting Officer*

DONALD J. QUIGG

*Commissioner of Patents and Trademarks*